US008339057B2

(12) United States Patent
Honsberg-Riedl et al.

(10) Patent No.: US 8,339,057 B2
(45) Date of Patent: Dec. 25, 2012

(54) CIRCUIT ARRANGEMENT, AND METHOD FOR THE OPERATION OF A HIGH-PRESSURE DISCHARGE LAMP

(75) Inventors: Martin Honsberg-Riedl, Teisendorf (DE); Peter Niedermeier, München (DE); Burkhard Ulrich, Rosenfeld (DE)

(73) Assignee: OSRAM GmbH, Munich (DE)

( * ) Notice: Subject to any disclaimer, the term of this patent is extended or adjusted under 35 U.S.C. 154(b) by 373 days.

(21) Appl. No.: 12/514,449

(22) PCT Filed: Nov. 9, 2006

(86) PCT No.: PCT/EP2006/068269

§ 371 (c)(1),
(2), (4) Date: May 11, 2009

(87) PCT Pub. No.: WO2008/055544

PCT Pub. Date: May 15, 2008

(65) Prior Publication Data

US 2010/0134032 A1 Jun. 3, 2010

(51) Int. Cl.
*H05B 41/16* (2006.01)
*H05B 41/24* (2006.01)

(52) U.S. Cl. ..... 315/246; 315/224; 315/291; 315/307

(58) Field of Classification Search ..... None
See application file for complete search history.

(56) References Cited

U.S. PATENT DOCUMENTS

| | | | | |
|---|---|---|---|---|
| 5,365,151 | A * | 11/1994 | Spiegel et al. | 315/209 R |
| 6,566,817 | B2 * | 5/2003 | Lapatovich | 315/85 |
| 6,680,582 | B1 * | 1/2004 | Cammack | 315/224 |
| 2003/0057882 | A1 | 3/2003 | Lapatovich | |
| 2003/0117085 | A1 | 6/2003 | Kramer | |
| 2004/0075392 | A1 * | 4/2004 | Arimoto et al. | 315/59 |
| 2004/0124785 | A1 * | 7/2004 | Alexandrov | 315/291 |

FOREIGN PATENT DOCUMENTS

| | | | |
|---|---|---|---|
| DE | 41 23 187 | A1 | 2/1993 |
| EP | 0 785 702 | A2 | 7/1997 |
| EP | 1298707 | A | 4/2003 |

OTHER PUBLICATIONS

M. Gulko et al., "A MHz electronic ballast for automotive-type HID lamps", Power Electronics Specialists Conference, 1997, PESC '97 Record, 28th Annual IEEE St. Louis, Mo., USA Jun. 22-27, 1997.

* cited by examiner

*Primary Examiner* — Anh Tran
(74) *Attorney, Agent, or Firm* — Cozen O'Connor

(57) ABSTRACT

A circuit arrangement for operating a high-pressure discharge lamp with an electronic ballast, which is designed to provide an AC feed signal for the high-pressure discharge lamp, the frequency of the AC feed signal being at least 1 MHz, wherein the electronic ballast is adapted to modulate the amplitude of the AC feed signal.

18 Claims, 5 Drawing Sheets

CIRCUIT ARRANGEMENT, AND METHOD FOR THE OPERATION OF A HIGH-PRESSURE DISCHARGE LAMP

RELATED APPLICATIONS

This is a U.S. national stage of application No. PCT/EP2006/068269, filed on Nov. 9, 2006.

FIELD OF THE INVENTION

The present invention relates to a circuit arrangement for operating a high-pressure discharge lamp with an electronic ballast, which is designed to provide an AC feed signal for the high-pressure discharge lamp, the frequency of the AC feed signal being at least 1 MHz. The invention moreover relates to a method for operating a high-pressure discharge lamp with an AC feed signal, the frequency of the AC feed signal being at least 1 MHz.

BACKGROUND OF THE INVENTION

High-pressure discharge lamps, as are used, for example, as video projection lamps, generally have two identical electrodes, which are usually rod-shaped. During operation of such high-pressure discharge lamps with alternating current, very disruptive flicker phenomena may arise. These flicker phenomena come about as a result of varying jumping of the root point of the arc at the electrode tips. This is made possible by the frequent change in the electrode function from the anodic (positive polarity) to the cathodic phase (negative polarity) at the operating frequency. Such jumping of the arc root in particular impairs the application of high-pressure discharge lamps in optical devices, for example projection devices, video projectors, microscope lights and can even result in unusability in the application.

U.S. Pat. No. 5,608,294 has disclosed, for low-frequency (50 Hz up to a few 100 Hz) operation of a high-pressure discharge lamp, superimposing short synchronous pulses on the square-wave lamp current profile for stabilization purposes, i.e. for preventing jumping of the root point of the arc. In this case, the current is increased for a short period of time at the end of a half cycle prior to subsequent commutation. In accordance with the cited document, the current pulse prior to commutation results in a short-term temperature increase at the live root points of the arc on the electrodes, primarily the instantaneous anode. As a result, material is deposited, i.e. the electrode metal tungsten from the gas cycle process is deposited with the tungsten halides on the electrodes, and peak formation occurs on the electrodes, which very effectively stabilizes the discharge and the root of the arc.

WO 03/098979 A1 has disclosed the operation of a high-pressure discharge lamp with an unmodulated RF signal of more than 3 MHz. In general, high-pressure discharge lamps permit successful RF operation only above frequencies which are above the acoustic resonances in the combustion chamber. These acoustic resonances result in strong flows in the combustion chamber which generally markedly disrupt the discharge arc. However, the literature mentions approaches for damping the acoustic resonances by means of suitable feed currents or of avoiding them entirely. By way of example, reference is made to DE 10 2005 028 417.5 and DE 10 2005 059 763.7. However, such solutions are usually very involved.

Finally, reference is made to DE 198 29 600 A1, which is concerned with RF operation of a high-pressure discharge lamp. It relates likewise in particular to the problem of jumping of the root of the arc on the electrode tips. It proposes the solution, on the basis of a prior art in which the high-pressure discharge lamps have been operated at a frequency of below 2 kHz, of operating the lamp at a frequency of above 800 kHz, preferably above 1 MHz and particularly preferably between 2 and 3 MHz. In a preferred development, the operating frequency is swept both continuously and suddenly with a modulation frequency of less than 10 kHz, preferably between 1 and 2 kHz. Although this can under certain circumstances for certain high-pressure discharge lamps represent a solution, this measure has proven to be ineffective in the high-pressure discharge lamps investigated by the inventors of the present invention.

SUMMARY OF THE INVENTION

One object of the present invention is to provide the circuit arrangement mentioned above or the method mentioned above in such a way that, in the cited frequency range, i.e. during RF operation of the high-pressure discharge lamp, the root of the arc is reliably prevented from jumping on the electrode tips.

The present invention is takes into consideration the knowledge that very effective stabilization of the arc can be achieved during radiofrequency operation if the amplitude of the AC feed signal is modulated. The reasons for this have not yet at present been wholly clarified since, in addition to amplitude overshoots, amplitude reductions also have the result according to the invention and lead to the avoidance of flicker phenomena of discharge arcs quite generally, in particular plasma arcs in high-pressure discharge lamps. An indication of this is the fact that a stabilizing peak formation similar to that which results during operation with the circuit arrangement proposed in the cited document U.S. Pat. No. 5,608,294 is set only after a few hours. In other words this means that the actual clarification for the solution according to the invention is not actually in the peak formation. As regards constancy in terms of time and location of the discharge arc, stabilization is achieved which in itself meets the stringent optical requirements placed on projection lamps.

In contrast to low-frequency operation, RF operation makes it possible to use simple, even single-stage ballasts. This makes it possible to use ballasts which are much smaller and therefore much more cost-effective than in the current prior art (LF operation).

In a preferred embodiment, the amplitude modulation represents pulse modulation. In this case, stabilization of the arc is achieved by pulsed, periodically repeated amplitude modulation of the AC feed signal, in particular outside of the range of relatively great acoustic resonances. In this case, the pulse modulation has a repetition rate of from 100 Hz to 100 kHz, preferably from 100 Hz to 2 kHz. The duty factor of the pulse modulation is preferably between 1% and 50%, preferably between 3% and 20%. From the point of view of video projection applications, duty factors at which the modulation pulses take advantage of only very short periods, in particular periods which are shorter than the blanking interval, have proven to be very advantageous.

The amplitude modulation of the AC feed signal can take place at a constant frequency, but it can also be accompanied by a change in frequency. In this case, the changed frequency is in a range of from −50% to +100%, preferably in a range of from −10% to +10%, of the frequency of the AC feed signal. As has already been mentioned, the pulse modulation is characterized by an amplitude overshoot in comparison with the unmodulated AC feed signal. Particularly good results as regards stabilization of the arc have been provided in the case of amplitude overshoots of between 20% and 1000%, preferably between 20% and 200%, of the amplitude of the unmodulated AC feed signal.

As has likewise already been mentioned, the pulse modulation can also be characterized by an amplitude reduction in comparison with the unmodulated AC feed signal. In this case, the amplitude reduction is between −5% and −90% of the unmodulated AC feed signal.

With the proviso that the proportion of the unmodulated AC feed signal is at least 50% within a period of the pulsed modulation, the pulse modulation can be characterized by a sequence of amplitude overshoots, a sequence of amplitude reductions and a sequence of amplitude overshoots and amplitude reductions, which alternate with one another. In this case, different variants have proven to be successful: the amplitude overshoots and/or the amplitude reductions can take place always toward positive amplitudes or always toward negative amplitudes or alternately toward positive and toward negative amplitudes or simultaneously toward positive or negative amplitudes of the unmodulated AC feed signal. In this case, the sequence of an amplitude overshoot with a directly following amplitude reduction or the reverse sequence has proven to be particularly advantageous from a thermal point of view. The success according to the invention has been achieved with a wide variety of pulse shapes, in particular with square-wave, delta, semi-sinusoidal pulse shapes, square-wave pulse shape with an exponential rise or a saw-tooth pulse shape.

In order to implement a circuit arrangement according to the invention, the electronic ballast in this circuit arrangement preferably has the following: an input terminal for connecting an input voltage, an output terminal for providing the AC feed signal to the high-pressure discharge lamp, and a series circuit comprising an inverter and a load network, which series circuit is arranged between the input terminal and the output terminal, the inverter providing an inverter output voltage with a predeterminable frequency, a predeterminable amplitude and a predeterminable duty factor to the load network.

Preferably, the predeterminable frequency and/or the predeterminable amplitude of the inverter output voltage is changed for amplitude modulation of the AC feed signal. Preferably, the load network has at least one transformer, which is arranged at the input and/or at the output and/or between the input and the output of the load network. This has proven to be particularly useful in the case of very low or high operating voltages or in the event of the demand for safe DC isolation, a possible example of which is the railway standard of 2 kV.

The load network is preferably designed in such a way that it can be brought to resonance by changing the predeterminable frequency of the inverter output voltage in order to thereby generate the starting voltage for starting the high-pressure discharge lamp. There is thus no need for a separate starting apparatus to be provided.

Preferably, the high-pressure discharge lamp has an operating pressure of from 100 to 500 bar.

Further advantageous embodiments are given in the dependent claims.

The preferred embodiments and developments proposed in connection with the circuit arrangement according to the invention and the advantages thereof apply correspondingly, if appropriate, to the method according to the invention.

BRIEF DESCRIPTION OF THE DRAWING(S)

An exemplary embodiment of a circuit arrangement according to the invention will now be described in more detail below with reference to the attached drawings, in which.

PREFERRED EMBODIMENT OF THE INVENTION

Figure 1:
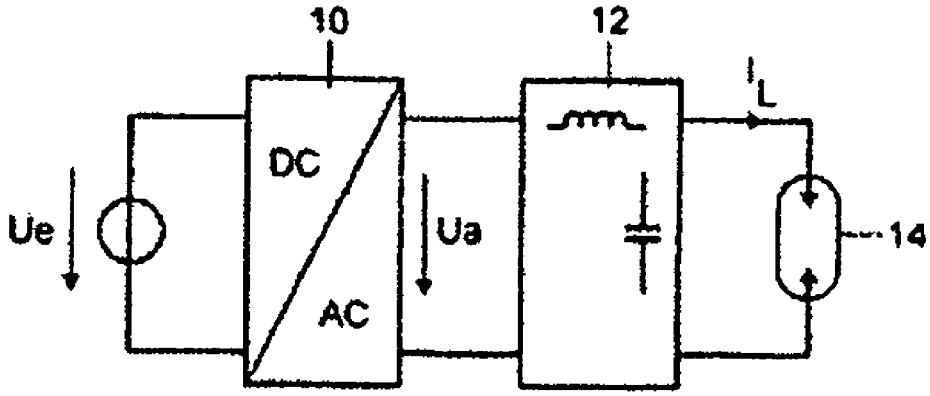
FIG. 1 shows a schematic illustration of the design of a circuit arrangement according to the invention.

FIG. 1 shows a schematic illustration of the design of a circuit arrangement according to the invention. The input voltage Ue, which can in particular represent the so-called intermediate circuit voltage, is in this case supplied to a radio frequency inverter 10. The output signal thereof is characterized by a predeterminable amplitude, a predeterminable frequency and a predeterminable duty factor. These predeterminable variables can be set via an interface (not illustrated) at the inverter 10. The output signal Ua of the inverter 10 is supplied to a load network 12. At the output thereof, a lamp current $I_L$ is provided to the high-pressure discharge lamp 14. In this case, the load network 12 forms the approximately sinusoidal lamp current $I_L$ from the output voltage Ua of the inverter 10 and is at the same time used for current limitation. Corresponding to the characteristic of the load network 12, the lamp current can be dependent both on the frequency and on the amplitude of the output voltage of the inverter. In order to generate the desired amplitude modulation of the lamp current $I_L$, either the frequency of the output voltage Ua and/or the amplitude can be changed. Preferably, the load network 12 is moreover designed in such a way that it can be brought to resonance by changing the predeterminable frequency of the output voltage Ua of the inverter in order thus to generate the starting voltage for the high-pressure discharge lamp.

FIG. 2 shows various embodiments of a suitable load network. Reference is made to the fact that, in the embodiments shown in FIGS. 2*a* and 2*d*, the capacitor $C_2$ can have a different design: firstly in order to contribute to the resonance network, and secondly merely for DC-voltage isolation. If at least one transformer is inserted at the input or at the output or between the input and the output of the load network 12, in particular DC isolation can therefore be ensured. In addition to the load networks illustrated with a T arrangement, pure series circuits comprising LC elements and circuits with a π arrangement can also be used for the purposes of the present invention. As is obvious to a person skilled in the art, the aims of the present invention can also be achieved by higher-order load networks.

Figure 3:
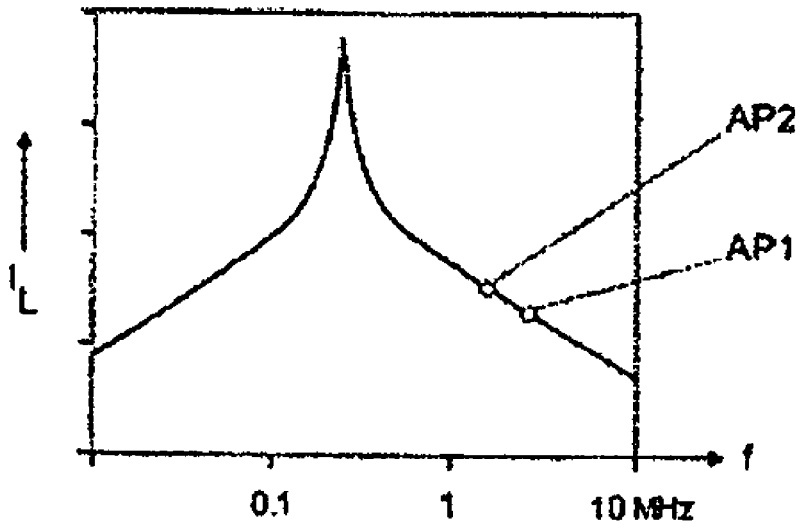
FIG. 3 shows, for the load network shown in FIG. 2*a*, the transfer function of the lamp current as a function of the frequency of the voltage at the input of the load network.
Figure 2A:
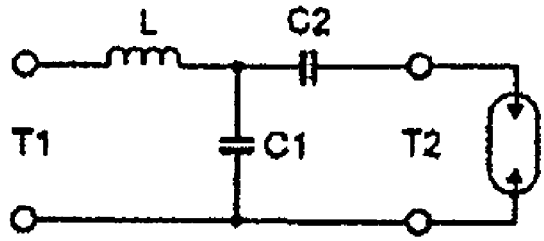
FIG. 2 shows a choice of different embodiments for a load network of the circuit arrangement from FIG. 1.
Figure 2B:
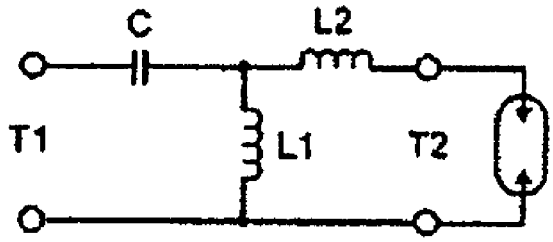
Figure 2C:
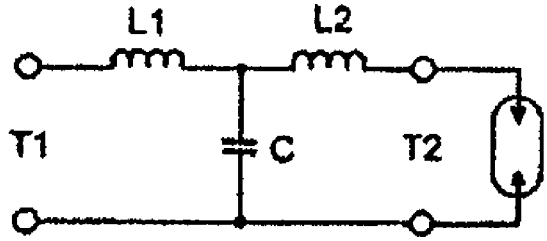
Figure 2D:
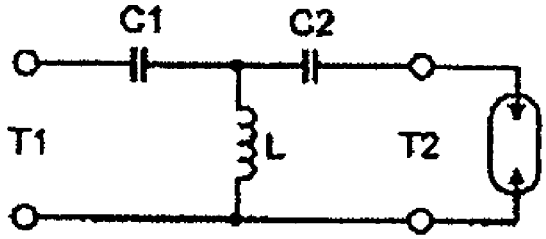
Figure 2E:
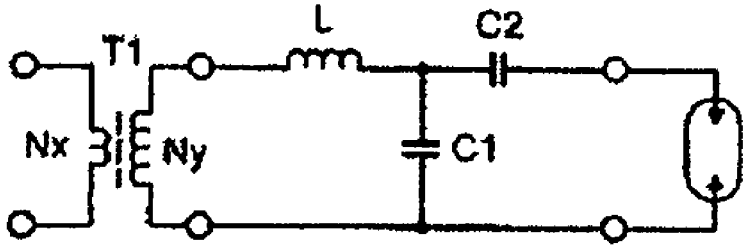
Figure 2F:
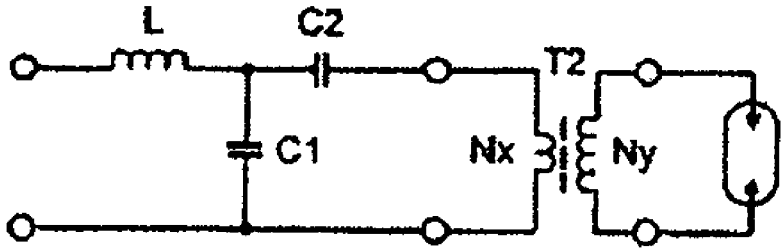
Figure 2G:
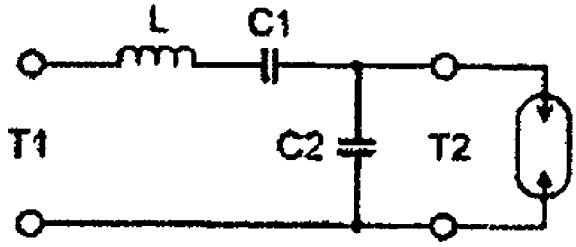
Figure 2H:
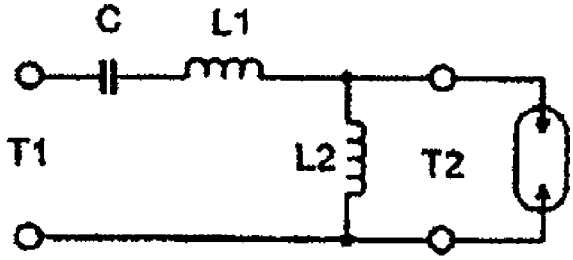

FIG. 3 shows the transfer function of the lamp current $I_L$ as a function of the frequency f of the input voltage Ue for the load network shown in FIG. 2*a*. The figure shows two working points AP1 and AP2, which we will come back to with reference to FIG. 8.

Figure 4:
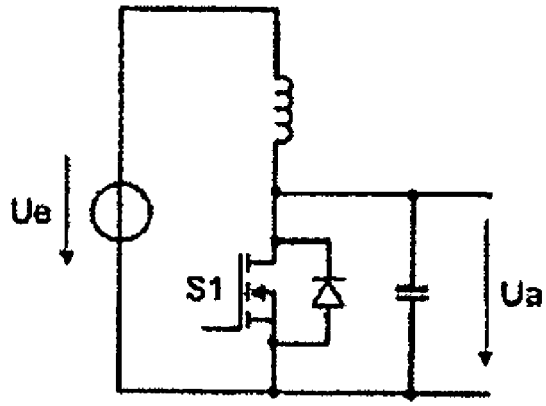
FIG. 4 shows a first embodiment of an inverter for the circuit arrangement in FIG. 1.
Figure 5:
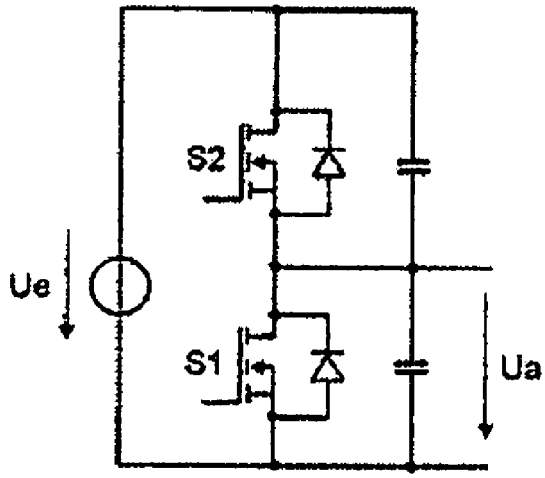
FIG. 5 shows a second embodiment of an inverter for the circuit arrangement in FIG. 1.

FIGS. 4 and 5 show examples of inverters 10, which are suitable for the circuit arrangement in FIG. 1. FIG. 4 in this case shows a class E converter with zero voltage switching (ZVS), and FIG. 5 shows a half bridge with zero voltage switching (ZVS). Since the inverters shown in FIGS. 4 and 5 are readily known to a person skilled in the art, no further details are given in this regard.

In order to generate the profile according to the invention of the lamp current $I_L$, in a simplest case the drive frequency of the switching transistors, S1 in FIG. 4 or S1 and S2 in FIG. 5, is subjected to frequency modulation. In this case, a voltage-controlled, variable-frequency oscillator can also be used, which is generally provided in any case for current or power regulation.

Figure 6:
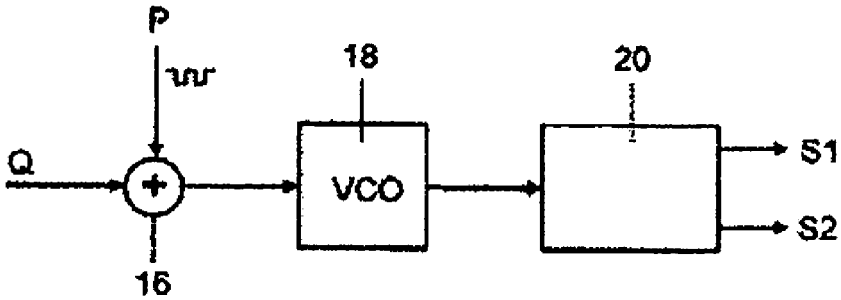
FIG. 6 shows a basic circuit diagram for generating pulse modulation using a VCO (voltage controlled oscillator)
Figure 8:
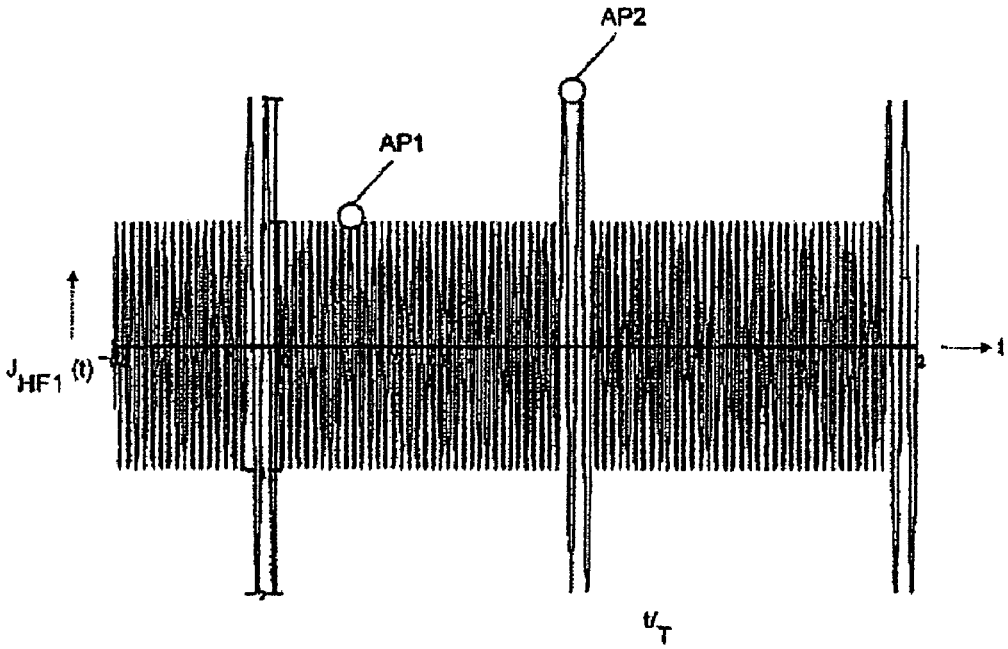
FIG. 8 shows the time profile of the AC feed signal, in which the frequency is additionally modulated during the pulse of the pulse modulation.

FIG. 6 shows the generation of the drive signals for the inverter shown in FIG. 5. In this case, a pulse signal P is added to the already existing control signal Q for the operation in the adder 16. This control signal is supplied to a VCO 18, which supplies it to a pulse shaper 20. Driver circuits are generally also provided in the pulse shaper 20. The drive signals for the switches S1, S2 of the inverter 10 are provided at the output of the pulse shaper 20. The time profile of the lamp current $I_L$ in this variant for driving the switches of the inverter is illustrated in FIG. 8. As can clearly be seen, the shift in the working point from AP1 to AP2 is associated with a change in the frequency. The frequency at the working point AP2 is lower than the frequency at the working point AP1, but the lamp current $I_L$ has a higher amplitude at the working point AP2 than at the working point AP1.

Figure 7:
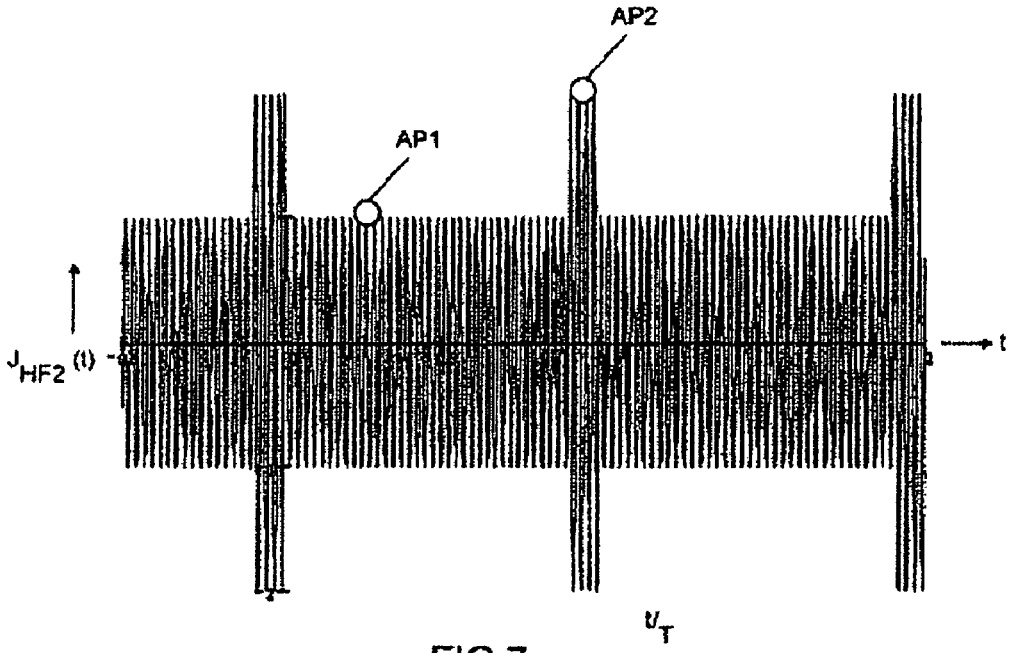
FIG. 7 shows the time profile of the AC feed signal without frequency modulation.

As an alternative, or at the same time, the modulation can be carried out by changing the amplitude of the input voltage of the inverter 10. Increasing this voltage over the pulse duration likewise makes it possible to achieve an increased lamp current $I_L$; see in this regard the time profile of the lamp current $I_L$ in FIG. 7, in which the amplitude is greater at the working point AP1 than the amplitude at the working point AP2, but the frequency remains unchanged. A quickly controllable DC-to-DC converter connected upstream is particularly preferably suitable for this implementation.

The scope of protection of the invention is not limited to the examples given hereinabove. The invention is embodied in each novel characteristic and each combination of characteristics, which includes every combination of any features which are stated in the claims, even if this feature or combination of features is not explicitly stated in the examples.

The invention claimed is:

1. A circuit arrangement for operating a high-pressure discharge lamp with an electronic ballast, which is designed to provide an AC feed signal for the high-pressure discharge lamp, the frequency of the AC feed signal being at least 1 MHz, the electronic ballast comprising:

an input terminal for connecting an input voltage;

an output terminal for providing the AC feed signal to the high-pressure discharge lamp; and a series circuit comprising an inverter and a load network, which series circuit is arranged between the input terminal and the output terminal, the inverter providing an inverter output voltage with a predeterminable frequency, a predeterminable amplitude and a predeterminable duty factor to the load network, wherein the electronic ballast is adapted to modulate the amplitude of the AC feed signal, wherein the load network has at least one transformer, which is arranged at the input and/or at the output and/or between the input and the output of the load network.

2. The circuit arrangement as claimed in claim 1, wherein the high-pressure discharge lamp has an operating pressure of from 100 to 500 bar.

3. The circuit arrangement as claimed in claim 1, wherein the amplitude modulation represents pulse modulation.

4. The circuit arrangement as claimed in claim 3, wherein the pulse modulation has a repetition rate of from 100 Hz to 100 kHz.

5. The circuit arrangement as claimed in claim 3, wherein the pulse modulation has a duty factor of between 1% and 50%.

6. The circuit arrangement as claimed in claim 3, wherein the pulse modulation is accompanied by a change in frequency.

7. The circuit arrangement as claimed in claim 6, wherein the changed frequency is in a range of from −50% to +100 of the frequency of the AC feed signal.

8. The circuit arrangement as claimed in claim 3, wherein the pulse modulation has an amplitude overshoot in comparison with the unmodulated AC feed signal.

9. The circuit arrangement as claimed in claim 8, wherein the amplitude overshoot is between 20% and 1000% of the amplitude of the unmodulated AC feed signal.

10. The circuit arrangement as claimed in claim 3, wherein the pulse modulation has an amplitude reduction in comparison with the unmodulated AC feed signal.

11. The circuit arrangement as claimed in claim 9, wherein the amplitude reduction is between −5% and −90% of the unmodulated AC feed signal.

12. The circuit arrangement as claimed in claim 8, wherein the proportion of the unmodulated AC feed signal is at least 50% within a period of the pulsed modulation.

13. The circuit arrangement as claimed in claim 12, wherein the pulse modulation comprises:

a sequence of amplitude overshoots;

a sequence of amplitude reductions; and a sequence of amplitude overshoots and amplitude reductions which alternate with one another.

14. The circuit arrangement as claimed in claim 13, wherein the amplitude overshoots and/or the amplitude reductions take place always toward positive amplitudes or always toward negative amplitudes or alternately toward positive and toward negative amplitudes or simultaneously toward positive or negative amplitudes of the unmodulated AC feed signal.

15. The circuit arrangement as claimed in claim 3, wherein the pulse shape is in square-wave, delta, semi-sinusoidal form, in square-wave form with an exponential rise or in saw-tooth form.

16. The circuit arrangement as claimed in claim 1, wherein the inverter is configured to change the predeterminable frequency and/or the predeterminable amplitude of the inverter output voltage for amplitude modulation of the AC feed signal.

17. The circuit arrangement as claimed in claim 1, wherein the load network is designed to be brought to resonance by changing the predeterminable frequency of the inverter output voltage in order to generate a starting voltage for the high-pressure discharge lamp.

18. The circuit arrangement as claimed in claim 3, wherein the pulse modulation has a repetition rate from greater than 1 kHz to 100 kHz.

* * * * *